US007453344B2

(12) United States Patent
Maeda et al.

(10) Patent No.: US 7,453,344 B2
(45) Date of Patent: Nov. 18, 2008

(54) MULTILAYER COIL COMPONENT

(75) Inventors: Tomoyuki Maeda, Yasu (JP); Mitsuru Ueda, Omihachiman (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 11/842,645

(22) Filed: Aug. 21, 2007

(65) Prior Publication Data

US 2007/0296538 A1 Dec. 27, 2007

Related U.S. Application Data

(63) Continuation of application No. PCT/JP2006/318831, filed on Sep. 22, 2006.

(30) Foreign Application Priority Data

Oct. 14, 2005 (JP) ..... 2005-300826

(51) Int. Cl.
*H01F 5/00* (2006.01)

(52) U.S. Cl. ..... 336/200; 336/223; 336/232

(58) Field of Classification Search ..... 336/223, 336/232, 200

See application file for complete search history.

(56) References Cited

U.S. PATENT DOCUMENTS 6,483,414 B2 * 11/2002 Takeuchi et al. ..... 336/200
6,715,197 B2 * 4/2004 Okuyama et al. ..... 29/592.1
6,871,391 B2 * 3/2005 Tokuda et al. ..... 29/602.1
7,046,114 B2 * 5/2006 Sakata ..... 336/200

FOREIGN PATENT DOCUMENTS

JP 06-112047 A 4/1994
JP 06-196334 A 7/1994
JP 11-097256 A 4/1999
JP 2996233 B1 12/1999

OTHER PUBLICATIONS

Official communication issued in the counterpart International Application No. PCT/JP2006/318831, mailed on Dec. 26, 2006.

* cited by examiner

*Primary Examiner*—Anh T Mai
(74) *Attorney, Agent, or Firm*—Keating & Bennett, LLP

(57) ABSTRACT

A multilayer coil component is constructed such that inductance can be finely adjusted and the coupling between two helical coils can be strengthened without increasing the types of patterns of coil conductors. Coil conductors of a first coil unit are connected to each other in series via via-hole conductors so as to form a first helical coil. Coil conductors of a second coil unit are connected to each other in series via via-hole conductors so as to form a second helical coil. The first and second helical coils are coaxially positioned, have different numbers of turns, and are electrically connected to each other in parallel. The sum of turns of the coil conductors facing each other at a portion where the first coil unit and the second coil unit are adjacent to each other is larger than the sum of turns of the coil conductors positioned on both outer sides in the coil axis direction of the first and second helical coils.

5 Claims, 8 Drawing Sheets

PRESENT INVENTION

COMPARATIVE EXAMPLE

PRESENT INVENTION

COMPARATIVE EXAMPLE

PRESENT INVENTION

COMPARATIVE EXAMPLE

MULTILAYER COIL COMPONENT

BACKGROUND OF THE INVENTION

1. Field of the Invention

The present invention relates to multilayer coil components, particularly to a multilayer coil component including two helical coils electrically connected to each other in parallel and laminated in a laminated body.

2. Description of the Related Art

Conventionally, a multilayer coil component described in Japanese Unexamined Patent Application Publication No. 6-196334 has been known. As shown in FIG. 8, the multilayer coil component 71 has a configuration in which a first coil unit 78 is stacked on a second coil unit 79, each coil unit including laminated ceramic sheets 72 provided with coil conductors 73*a* to 73*e* and via-hole conductors 75. The coil conductors 73*a* to 73*e* are mutually connected in series via the via-hole conductors 75 so as to form helical coils 73A and 73B. The two helical coils 73A and 73B are electrically connected to each other in parallel so as to form a multilayer coil component having a large withstand current value.

In the multilayer coil component 71, however, the two helical coils 73A and 73B have the same pattern and the same number of turns. Thus, if the number of turns is changed to adjust inductance, the number of turns increases or decreases in the two helical coils at the same time. This causes a significant change in inductance and a problem that fine adjustment of inductance is difficult.

As shown in FIG. 9, when a multilayer coil component 81 having a configuration in which coil conductors 73*e* and 74*a* of a large number of turns face each other is fabricated for the purpose of strengthening the coupling between two helical coils 73A and 74A, coil conductors of patterns denoted by numerals 74*a* to 74*e* need to be newly formed. That is, the positions of the via-hole conductors 75 are different in the same patterns of coil conductors, and thus, the types of patterns of the coil conductors increase disadvantageously.

SUMMARY OF THE INVENTION

In order to overcome the problems described above, preferred embodiments of the present invention provide a multilayer coil component in which inductance can be finely adjusted and the coupling between two helical coils can be strengthened without increasing the types of patterns of coil conductors.

A multilayer coil component according to a preferred embodiment of the present invention includes a first coil unit including a plurality of coil conductors and a plurality of ceramic layers that are laminated and including a first helical coil; a second coil unit including a plurality of coil conductors and a plurality of ceramic layers that are laminated and including a second helical coil; and a laminated body including the first coil unit stacked on the second coil unit. The first helical coil and the second helical coil are coaxially positioned, are electrically connected to each other in parallel, and have different numbers of turns. The sum of turns of the coil conductors facing each other of the first and second helical coils at a portion where the first and second coil units are adjacent to each other is larger than the sum of turns of the coil conductors positioned on both outer sides in the coil axis direction of the first and second helical coils. An input leading electrode of either one of the first and second helical coils and an output leading electrode of the other helical coil are adjacent to each other in the lamination direction.

In the multilayer coil component according to a preferred embodiment of the present invention, the first and second helical coils are coaxially positioned and are connected to each other in parallel, and thus, a withstand current value is large. Since the first and second helical coils have different numbers of turns, inductance can be finely adjusted by individually changing the number of turns. Furthermore, since the sum of turns of the coil conductors facing each other of the first and second helical coils at a portion where the first and second coil units are adjacent to each other is larger than the sum of turns of the coil conductors positioned on both outer sides in the coil axis direction of the first and second helical coils, the coupling between the two helical coils is strengthened and inductance increases. In addition, since the input leading electrode of any one of the helical coils and the output leading electrode of the other helical coil are adjacent to each other in the laminated direction, the types of patterns of the coil conductors does not increase regardless of the strong coupling between the coils.

In the multilayer coil component according to various preferred embodiments of the present invention, it is preferable that an input leading electrode of either one of the first and second helical coils and an output leading electrode of the other helical coil are led to end surfaces opposite to each other of the laminated body. With this configuration, external electrodes can be formed over the end surfaces of the laminated body, so that manufacturing can be easily performed.

Preferably, input leading electrodes or output leading electrodes of the first and second helical coils have the same pattern. By using the same pattern, the manufacturing process is simplified.

When each of the coil conductors in a main portion of the first and second helical coils has a substantially ¾-turn shape, the number of laminated layers of the coil conductors reduces and the component can be miniaturized. Preferably, in a plan view in the laminated direction, the plurality of coil conductors are substantially rectangular, the via-hole conductors are located at two points in each of long sides of the substantially rectangular shape, and the via-hole conductors are not placed on the same straight line in the short side direction of the substantially rectangular shape. Accordingly, the via-hole conductors are isolated from each other and a short circuit can be prevented.

According to various preferred embodiments of the present invention, a withstand current value is large, inductance can be finely adjusted, the coupling between the first and second helical coils can be strengthened, inductance can be increased, and the number of types of patterns of necessary coil conductors is small.

Other features, elements, steps, characteristics and advantages of the present invention will be described below with reference to preferred embodiments thereof and the attached drawings.

BRIEF DESCRIPTION OF THE DRAWINGS

FIGS. 4A and 4B illustrate multiplayer coil components using the sheets illustrated in FIG. 3, wherein FIG. 4A is an exploded perspective view of a preferred embodiment of the present invention and FIG. 4B is an exploded perspective view of a comparative example.

FIGS. 5A and 5B illustrate other multiplayer coil components using the sheets illustrated in FIG. 3, wherein FIG. 5A is an exploded perspective view of a preferred embodiment of the present invention and FIG. 5B is an exploded perspective view of a comparative example.

FIGS. 6A and 6B illustrate other multiplayer coil components using the sheets illustrated in FIG. 3, wherein FIG. 6(A) is an exploded perspective view of a preferred embodiment of the present invention and FIG. 6(B) is an exploded perspective view of a comparative example.

DETAILED DESCRIPTION OF PREFERRED EMBODIMENTS

Hereinafter, preferred embodiments of a multilayer coil component according to the present invention are described with reference to the attached drawings.

First Preferred Embodiment

Figure 1:
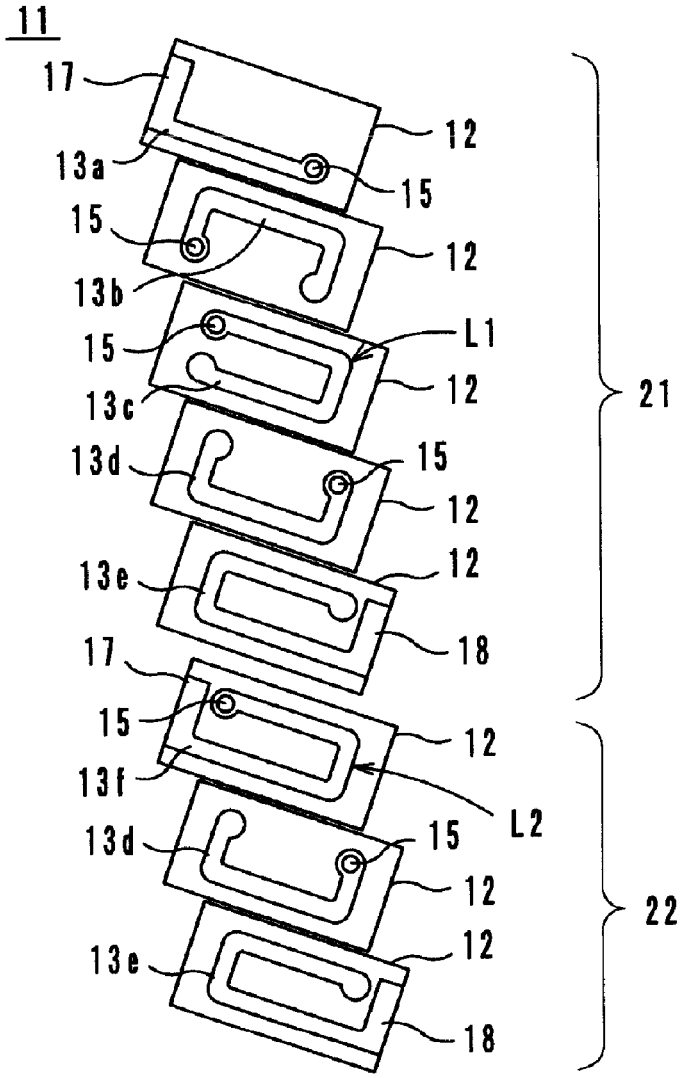
FIG. 1 is an exploded perspective view of a first preferred embodiment of a multilayer coil component according to the present invention.

As shown in FIG. 1, a multilayer coil component 11 according to a first preferred embodiment has the following configuration. A first coil unit 21 including laminated ceramic green sheets 12 provided with coil conductors 13*a* to 13*e* and via-hole conductors 15 is stacked on a second coil unit 22 including laminated ceramic green sheets 12 provided with coil conductors 13*f*, 13*d*, and 13*e* and via-hole conductors 15, and protective ceramic green sheets (not shown) are further laminated at the top and bottom.

The ceramic green sheets 12 are preferably fabricated in the following way. First, materials including ferrite powder, a bonding agent, and a plasticizing agent are mixed and crushed by a ball mill into a slurry composition, and vacuum defoaming is performed thereon. The obtained result is formed into sheets each having a predetermined thickness by a doctor blade method or the like.

Next, a hole serving as a via-hole is formed by laser irradiation at a predetermined position of each of the ceramic green sheets 12. Then, an Ag-based conductive paste is screen-printed on the ceramic green sheets 12 so as to form the coil conductors 13*a* to 13*f*, input leading electrodes 17, and output leading electrodes 18. At the same time, the conductive paste is filled in the holes serving as via-holes, so that the via-hole conductors 15 are formed.

Each of the coil conductors 13*b* to 13*f* in a main portion of the first and second coil units 21 and 22 preferably has a ¾-turn shape (not including the leading electrodes 17 and 18). Accordingly, a coil conductor can be elongated on each sheet 12 and the number of laminated sheets 12 can be reduced, so that the component can be miniaturized.

Then, the ceramic green sheets and the protective ceramic green sheets are laminated to form a laminated body. The laminated body is cut into a predetermined size and is fired at predetermined temperature for predetermined time. Furthermore, the conductive paste is applied on end surfaces where the leading electrodes 17 and 18 are exposed, preferably by an immersion method or the like, so as to form external electrodes.

Figure 2:
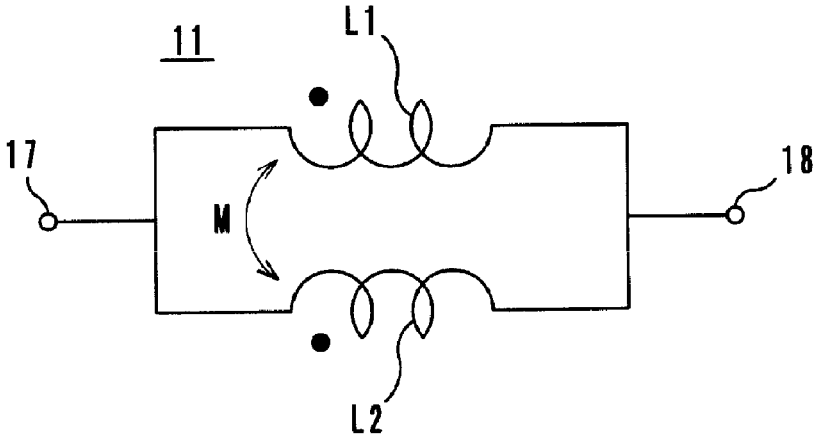
FIG. 2 is an equivalent circuit diagram of the multilayer coil component shown in FIG. 1.

In the multilayer coil component 11 obtained in the above-described way, the coil conductors 13*a* to 13*e* of the first coil unit 21 are connected to each other in series via the via-hole conductors 15 so as to form a helical coil L1. Likewise, the coil conductors 13*f*, 13*d*, and 13*e* of the second coil unit 22 are connected to each other in series via the via-hole conductors 15 so as to form a helical coil L2. The two helical coils L1 and L2 are electrically connected to each other in parallel, as shown in FIG. 2. Accordingly, the multilayer coil component 11 of a large withstand current value can be obtained.

The helical coils L1 and L2 are coaxially positioned and have different numbers of turns. Specifically, the coil L1 preferably has 3.25 turns and the coil L2 preferably has 2.25 turns, for example. The input leading electrodes 17 of the helical coils L1 and L2 are positioned on the left of the multilayer coil component 11, while the output leading electrodes 18 thereof are positioned on the right. The output leading electrode 18 of the helical coil L1 and the input leading electrode 17 of the helical coil L2 are adjacent to each other in the laminated direction and are led to the end surfaces opposite to each other of the laminated body. The output leading electrodes 18 of the helical coils L1 and L2 and the coil conductors 13*e* connected thereto have the same pattern.

In the multilayer coil component 11 having the above-described configuration, the withstand current value is large because the helical coils L1 and L2 are connected to each other in parallel. Furthermore, since the number of turns is different in each of the helical coils L1 and L2, inductance can be finely adjusted by individually changing the number of turns of the coils L1 and L2.

The output leading electrodes 18 of the helical coils L1 and L2 and the coil conductors 13*e* connected thereto preferably have the same pattern. Also, the sum of turns of the coil conductors 13*e* and 13*f* facing each other of the coils L1 and L2 at a portion where the first and second coil units 21 and 22 are adjacent to each other is larger than the sum of turns of the coil conductors 13*a* and 13*e* positioned on both outer sides in the coil axis direction of the coils L1 and L2. Specifically, in the first preferred embodiment, the sum of turns of the coil conductors 13*e* and 13*f* facing each other preferably is 1.5 turns, and each of the conductors 13*e* and 13*f* has ¾ turns. The sum of turns of the coil conductors 13*a* and 13*e* on the outer sides preferably is 1 turn, and the conductor 13*a* has ¼ turns and the conductor 13*e* has ¾ turns.

In this way, the large sum of turns of the coil conductors 13*e* and 13*f* facing each other causes a large amount of magnetic flux coupling, so that the magnetic flux coupling between the helical coils L1 and L2 becomes strong. The strong magnetic flux coupling causes a large mutual inductance M (see FIG. 2) and a large composite inductance of the helical coils L1 and L2.

Figure 9:
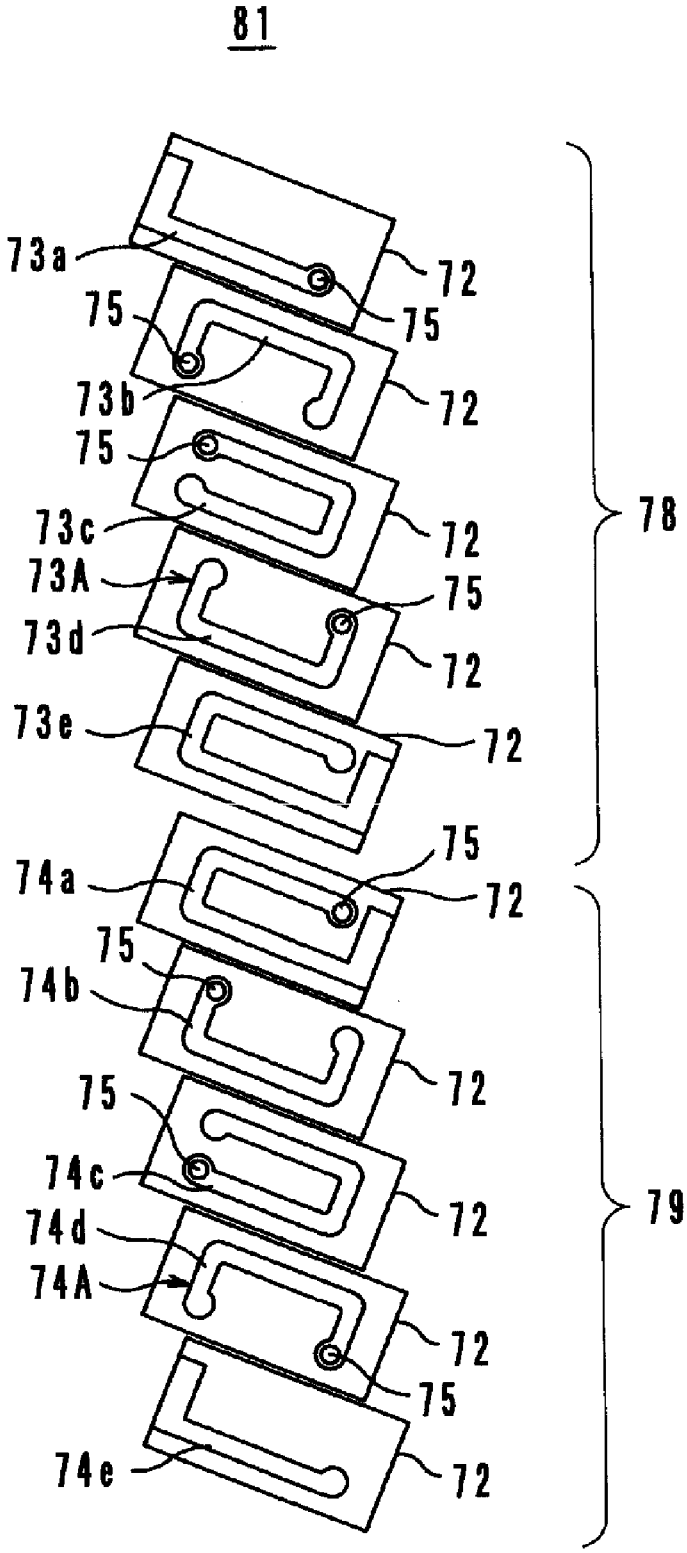
FIG.9 PRIOR ART
FIG. 9 is an exploded perspective view of another known multilayer coil component.

Furthermore, since the output leading electrode 18 and the input leading electrode 17 of the helical coils L1 and L2 are adjacent to each other in the laminated direction and are led to the end surfaces opposite to each other of the laminated body. Accordingly, as is clear from comparison with the multilayer coil component 81 shown in FIG. 9, the types of patterns of the coil conductors do not increase although the coupling between the coils L1 and L2 is strong.

Second Preferred Embodiment

Figure 3:
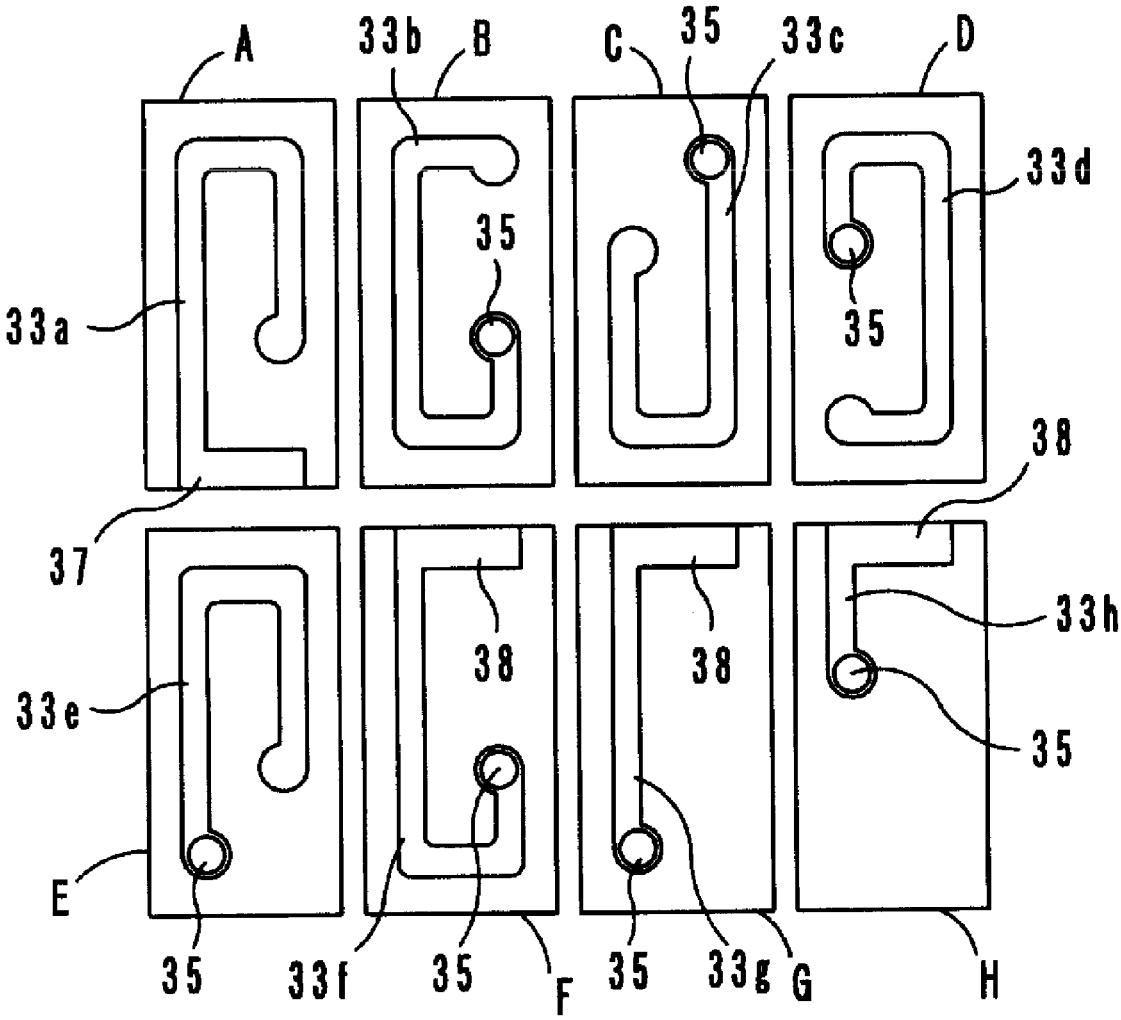
FIG. 3 is a plan view of various sheets used in a second preferred embodiment of the multilayer coil component according to the present invention.

In the second preferred embodiment, various multilayer coil components are fabricated by using, for example, eight types of sheets A to H shown in FIG. 3. In the sheets A to H, coil conductors 33*a* to 33*h*, an input leading electrode 37, output leading electrodes 38, and via-hole conductors 35 are provided on ceramic green sheets. As described below in detail, the respective via-hole conductors 35 are arranged in an offset state. Accordingly, spaces between the via-hole conductors 35 become wide and a short circuit can be prevented.

Figure 4A:
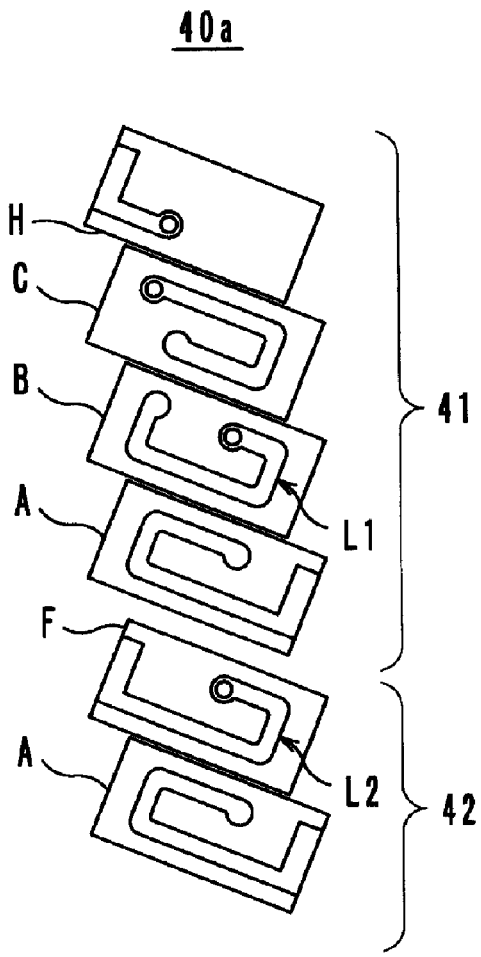
Figure 4B:
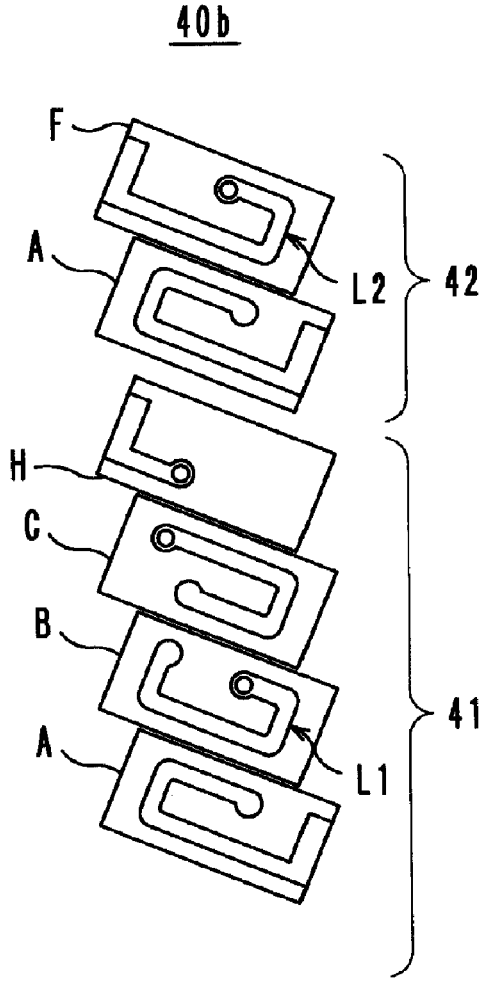

FIG. 4A illustrates a multilayer coil component 40*a* including a first coil unit 41 including a helical coil L1 and a second coil unit 42 including a helical coil L2. For comparison, FIG. 4B illustrates a multilayer coil component 40*b* in which the laminated positions of the first and second coil units 41 and 42 are interchanged.

Figure 5A:
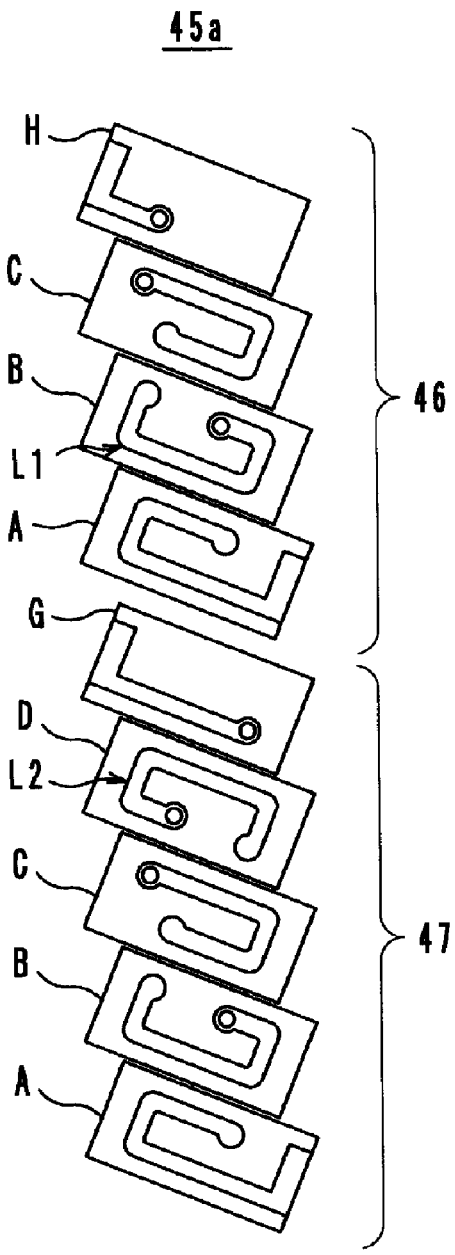
Figure 5B:
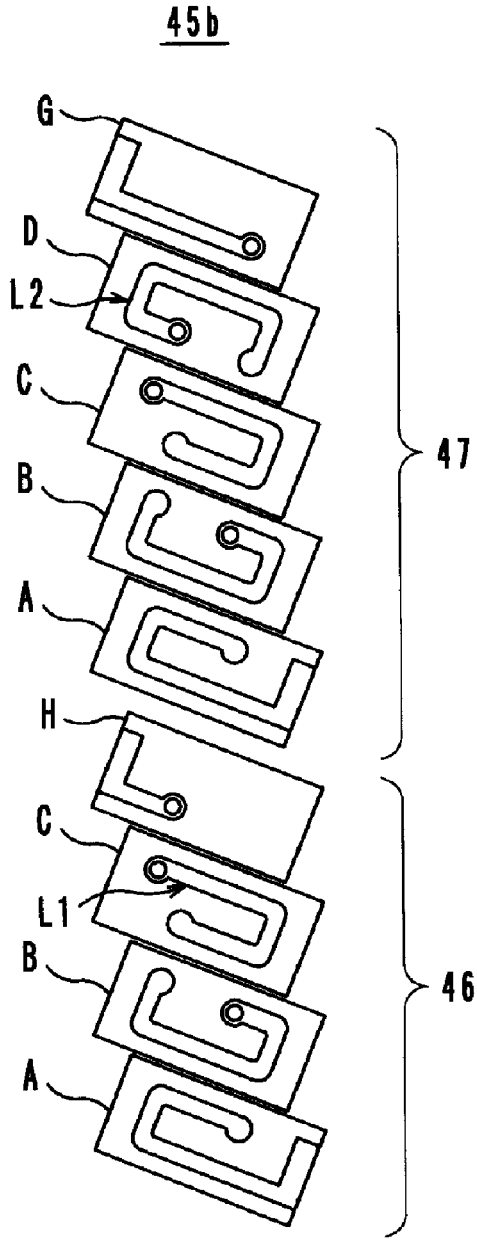

FIG. 5A illustrates a multilayer coil component 45*a* including a first coil unit 46 including a helical coil L1 and a second coil unit 47 including a helical coil L2. For comparison, FIG. 5B illustrates a multilayer coil component 45*b* in which the laminated positions of the first and second coil units 46 and 47 are interchanged.

Figure 6A:
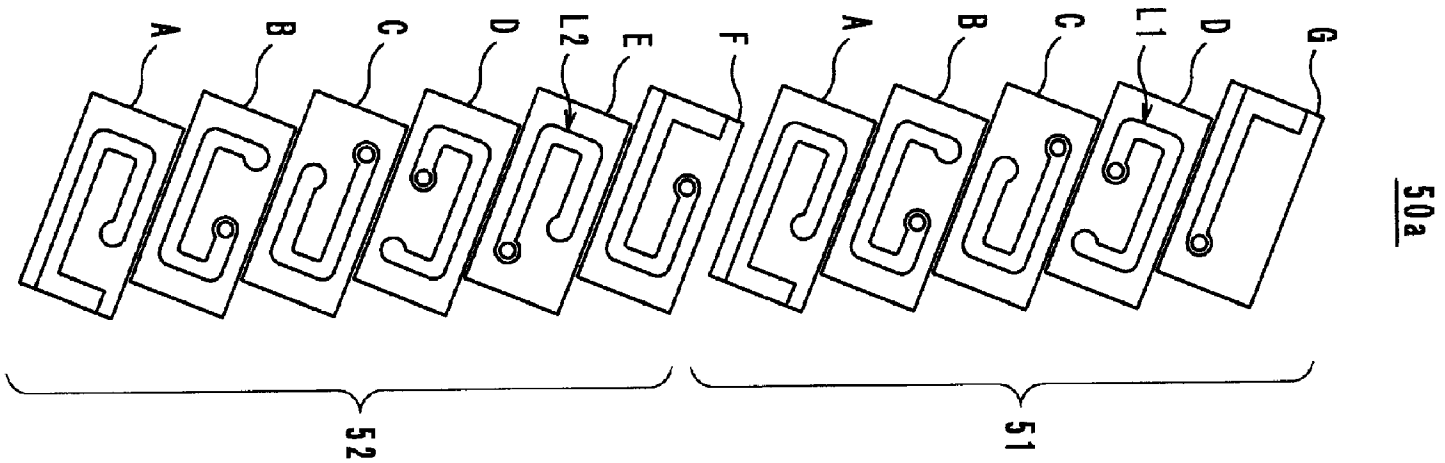
Figure 6B:
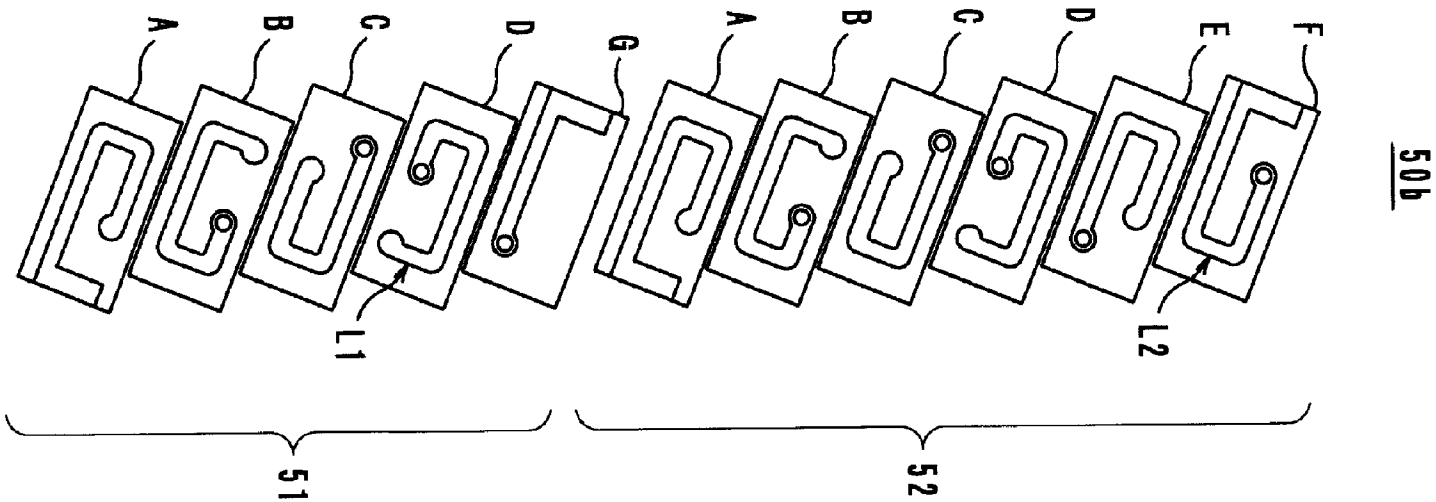

FIG. 6A illustrates a multilayer coil component 50*a* including a first coil unit 51 including a helical coil L1 and a second coil unit 52 including a helical coil L2. For comparison, FIG. 6B illustrates a multilayer coil component 50*b* in which the laminated positions of the first and second coil units 51 and 52 are interchanged.

The multilayer coil components 40*b*, 45*b*, and 50*b* are not known, but are newly fabricated as comparative examples to verify the effect of preferred embodiments of the present invention.

Figure 7:
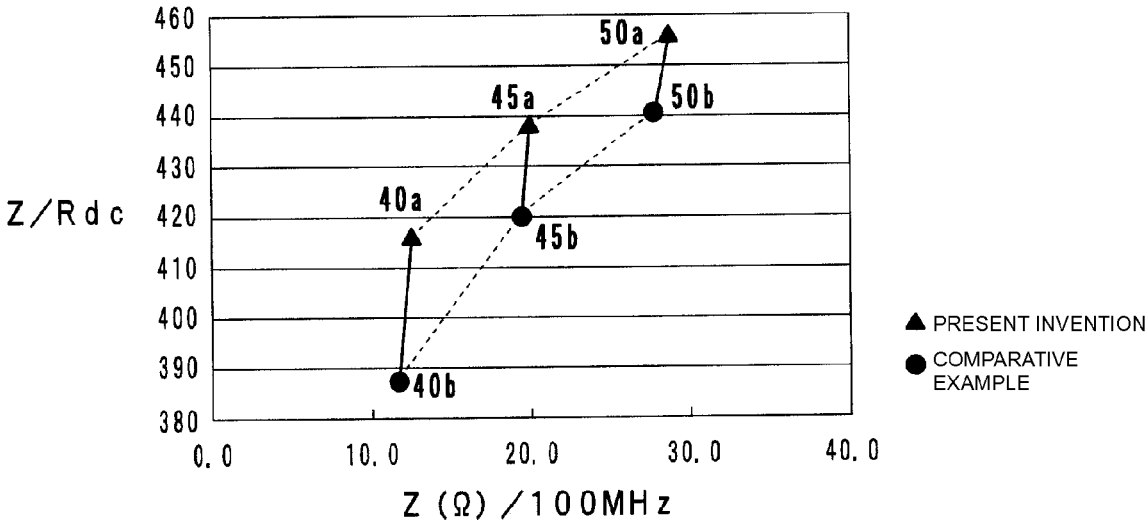
FIG. 7 is a graph illustrating electrical characteristics of the multilayer coil components illustrated in FIGS. 4A to 6B.
Figure 8:
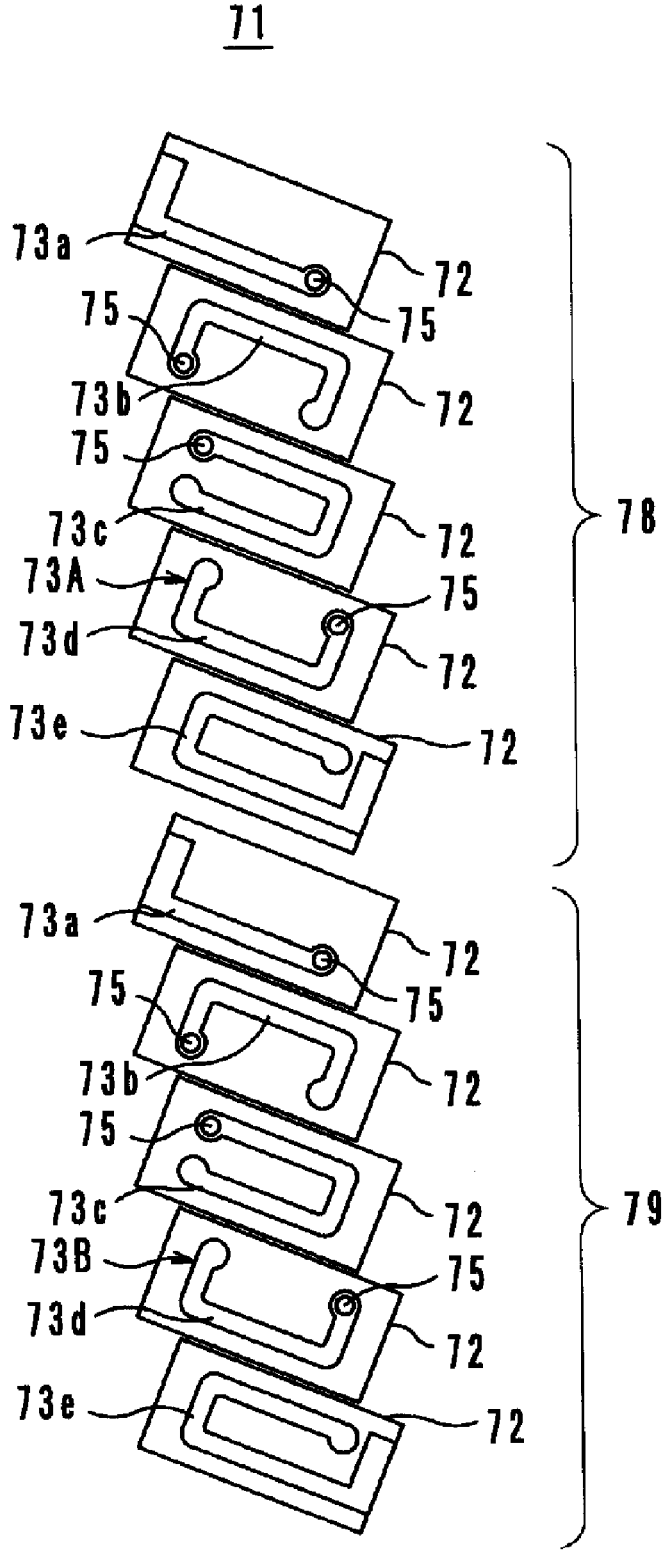
FIG.8 PRIOR ART
FIG. 8 is an exploded perspective view of a known multilayer coil component.

Table 1 and FIG. 7 illustrate evaluation results of impedance Z at 100 MHz, DC resistance Rdc, and acquisition efficiency ((impedance at 100 MHz)/(DC resistance))of the multilayer coil components 40*a*, 40*b*, 45*a*, 45*b*, 50*a*, and 50*b*. A more preferable effect can be obtained as the value of acquisition efficiency Z/Rdc is larger.

TABLE 1

| | Samples | | | | | |
|---|---|---|---|---|---|---|
| | 40a | 40b | 45a | 45b | 50a | 50b |
| Z (Ω)/ 100 MHz | 12.6 | 11.7 | 20.1 | 19.5 | 28.6 | 27.5 |
| Rdc (Ω) | 0.030 | 0.030 | 0.046 | 0.046 | 0.063 | 0.062 |
| Z/Rdc | 416 | 387 | 437 | 420 | 456 | 441 |

As is clear from Table 1 and FIG. 7, when the sum of turns of the coil conductors facing each other of the helical coils L1 and L2 at a portion where the first coil unit 41, 46, or 51 and the second coil unit 42, 47, or 52 are adjacent to each other is larger than the sum of turns of the coil conductors on both outer sides in the coil axis direction of the coils L1 and L2, the magnetic flux coupling is strong and the mutual inductance M is large. As a result, the composite inductance of the two helical coils L1 and L2 is large.

In the second preferred embodiment (see FIG. 5(A) and FIG. 6(A)), the via-hole conductors 35 are arranged in an offset state. That is, in a plan view in the laminated direction, the plurality of coil conductors 33*a* to 33*h* define the helical coils L1 and L2 to have a substantially rectangular shape. The via-hole conductors 35 are located at two points in each of the longer sides of the substantially rectangular shape and are not located on the same straight line in the short side direction of the substantially rectangular shape. In this way, by distributing the via-hole conductors 35 in an offset state in a plan view, a short circuit among the via-hole conductors 35 can be prevented.

Other Preferred Embodiments

The multilayer coil component according to the present invention is not limited to the above-described preferred embodiments, but can be variously modified within the scope of the present invention.

For example, the shape of the coil conductors is not limited to just being substantially rectangular, but may be substantially circular or another suitable shape. In the above-described preferred embodiments, the multilayer coil component is preferably made by laminating ceramic sheets and then integrally firing the ceramic sheets. Alternatively, the ceramic sheets may be fired before being laminated.

In the above-described preferred embodiments, the coil conductors are led to the end surfaces on the short side of the laminated body. Alternatively, the coil conductors may be led to the end surfaces on the long side of the laminated body. Also, many of the coil conductors may have a substantially ½-turn shape, instead of a substantially ¾-turn shape.

Also, the multilayer coil component may be fabricated by the following method. That is, a ceramic layer is formed by using ceramic paste in a printing method or the like, and conductive paste is applied on a surface of the ceramic layer so as to form a coil conductor. Then, ceramic paste is applied thereon to form a ceramic layer, and then a coil conductor is further formed. In this way, by alternately laminating a ceramic layer and a coil conductor layer, a multilayer coil component having a laminated configuration can be obtained.

As described above, the present invention is useful in a multilayer coil component including two helical coils that are electrically connected to each other in parallel and that are stacked in a laminated body. Particularly, the present invention is excellent in that inductance can be finely adjusted and that the coupling between the two helical coils can be strengthened without increasing the types of patterns of coil conductors.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A multilayer coil component comprising:

a first coil unit including a plurality of coil conductors and a plurality of ceramic layers that are laminated and including a first helical coil;

a second coil unit including a plurality of coil conductors and a plurality of ceramic layers that are laminated and including a second helical coil; and a laminated body including the first coil unit stacked on the second coil unit in a lamination direction; wherein the first helical coil and the second helical coil are coaxially positioned, are electrically connected to each other in parallel, and have different numbers of turns;

the sum of turns of the coil conductors of the first and second helical coils which are opposed to each other at a portion where the first and second coil units are adjacent to each other is larger than the sum of turns of the coil conductors of the first and second helical coils positioned on both outer sides in the coil axis direction; and an input leading electrode of either one of the first and second helical coils and an output leading electrode of the other of the first and second helical coils are adjacent to each other in the lamination direction.

2. The multilayer coil component according to claim 1, wherein an input leading electrode of either one of the first and second helical coils and an output leading electrode of the other of the first and second helical coils extend to end surfaces opposite to each other of the laminated body.

3. The multilayer coil component according to claim 1, wherein input leading electrodes or output leading electrodes of the first and second helical coils have the same pattern.

4. The multilayer coil component according to claim 1, wherein each of the coil conductors in a main portion of the first and second helical coils has a substantially ¾-turn shape.

5. The multilayer coil component according to claim 1, wherein, in a plan view in the lamination direction, the plurality of coil conductors have a substantially rectangular shape, via-hole conductors are located at two points in each of longer sides of the substantially rectangular shape, and the via-hole conductors are not located along a common straight line in a short side direction of the substantially rectangular shape.

* * * * *